US006680127B2

(12) United States Patent
Capps

(10) Patent No.: US 6,680,127 B2
(45) **Date of Patent: *Jan. 20, 2004**

(54) ANTIFUNGAL GYPSUM BOARD

(75) Inventor: Charles L. Capps, Little Rock, AR (US)

(73) Assignee: Temple-Inland Forest Products, Corporation, Diboll, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/244,984

(22) Filed: Sep. 17, 2002

(65) Prior Publication Data

US 2003/0031898 A1 Feb. 13, 2003

Related U.S. Application Data

(63) Continuation-in-part of application No. 10/210,680, filed on Aug. 1, 2002, and a continuation of application No. PCT/US02/24765, filed on Aug. 1, 2002.

(60) Provisional application No. 60/310,442, filed on Aug. 3, 2001.

(51) Int. Cl.[7] ..... B32B 29/00; A01N 33/02; A01N 25/34

(52) U.S. Cl. ..... 428/537.7; 106/15.05; 106/18.32; 106/18.35; 106/778; 106/780; 106/781; 156/39; 156/44; 162/160; 162/161; 424/413; 424/414; 428/70; 428/537.5; 428/907

(58) Field of Search ..... 106/15.05, 18.32, 106/18.35, 778, 780, 781; 156/39, 44; 428/537.5, 537.1, 907, 70; 162/160, 161; 424/413, 414; 514/642

(56) References Cited

U.S. PATENT DOCUMENTS

| | | | | | |
|---|---|---|---|---|---|
| 3,567,118 | A | * | 3/1971 | Shepherd et al. | 239/6 |
| 3,786,615 | A | * | 1/1974 | Bauer | 53/429 |
| 3,918,981 | A | * | 11/1975 | Long | 106/16 |
| 3,998,944 | A | * | 12/1976 | Long | 424/413 |
| 4,323,565 | A | * | 4/1982 | Hasegawa et al. | 514/223.8 |
| 5,707,736 | A | * | 1/1998 | Levy et al. | 428/375 |
| 5,935,384 | A | * | 8/1999 | Taniguchi | 162/172 |
| 6,387,172 | B1 | * | 5/2002 | Yu et al. | 106/680 |
| 6,481,171 | B2 | * | 11/2002 | Yu et al. | 52/443 |

FOREIGN PATENT DOCUMENTS

| | | | |
|---|---|---|---|
| EP | 0734186 | | 10/1996 |
| JP | 54-132622 | * | 10/1979 |
| JP | 59-121173 | * | 7/1984 |
| JP | 59121173 | | 7/1984 |
| JP | 3075142 | | 8/1989 |
| JP | 4-69301 | * | 3/1992 |
| JP | 5-161566 | * | 6/1993 |
| JP | 8-34655 | * | 2/1996 |
| JP | 10017351 | | 1/1998 |
| JP | 2001-70192 | * | 3/2001 |
| WO | 02/22976 | * | 3/2002 |

OTHER PUBLICATIONS

Derwent Abstract No. 2001–569492, abstract of Korean Patent Specification No. 2001025705 (Apr. 2001).*

International Search Report, PCT/US02/29447, Jun. 4, 2003, WIPO.

Rabasco, et al.; *"Polymer Emulsion Preservation Using Cationic Compounds"*, U.S. patent application Publication 2002/0099113, Jul. 25, 2002.

International Search Report, PCT/US02/24765, Nov. 19, 2002, WIPO.

* cited by examiner

*Primary Examiner*—Anthony J. Green
(74) *Attorney, Agent, or Firm*—Conley Rose, P.C.; Rodney B. Carroll

(57) ABSTRACT

A novel gypsum board having antifungal properties is disclosed. The board comprises a gypsum core, front and back paper facings and an antifungal agent effective at inhibiting fungal growth. A preferred antifungal agent is cetylpyridinium chloride. The antifungal agent can be present in the gypsum core and/or on one or both of the paper facings. In addition, the antifungal agent may be encapsulated in a material that releases the antifungal agent over time and/or upon exposure to moisture. Also disclosed are methods for preparing the aforementioned antifungal gypsum board.

24 Claims, No Drawings

ANTIFUNGAL GYPSUM BOARD

CROSS-REFERENCE TO RELATED APPLICATIONS

The present application is a continuation-in-part application of U.S. utility application Ser. No. 10/210,680, filed Aug. 1, 2002, entitled "Antifungal Gypsum Board," which claims the benefit of priority from 35 U.S.C. 111(b) provisional application Serial No. 60/310,442, filed Aug. 03, 2001, and entitled "Antifungal Gypsum Board and Method for Making Same." The present application further is a continuation and claims the benefit under 35 U.S.C §120 of PCT international application designating the U.S. Ser. No. PCT/US/02/24765, filed Aug. 1, 2002, and entitled "Antifungal Gypsum Board." Each of the above-listed applications is hereby incorporated herein by reference for all purposes.

STATEMENT REGARDING FEDERALLY SPONSORED RESEARCH OR DEVELOPMENT

Not Applicable.

BACKGROUND OF THE INVENTION

1. Technical Field of the Invention

The present invention relates generally to gypsum board and methods for making gypsum board. More specifically, the present invention relates to gypsum board possessing antifungal properties and methods of making same.

2. Description of Related Art

Gypsum board, which is sold as wall board and drywall, is a common building material used in various applications including interior walls, partitions and ceiling construction. Commercial gypsum board products are popular for a variety of reasons. They are durable, economical and fire-retardant. In addition, these boards provide excellent compressive-strength properties and a relatively low density. Finally, they are easily decorated and are therefore attractive as surfacing materials, especially for interior construction.

One fundamental limitation of traditional gypsum board products is their susceptibility to moisture absorption in damp environments. To minimize this problem, gypsum board is normally used in interior construction where exposure to moisture is limited. Unfortunately, products used in interior construction sometimes encounter water due to seepage, leaky roofs or pipes, flooding, condensation, and the like, arising out of construction defects or other events unrelated to the manufacture of the gypsum board. Thus, a number of mechanisms result in the exposure of gypsum board products to moisture. Once exposed to moisture, traditional gypsum board products are susceptible to fungal growth.

There is an ongoing need for gypsum board products that offer reduced susceptibility to fungal growth without compromising their beneficial properties. In addition, there is an ongoing need for commercially-viable manufacturing methods for such products. The present invention solves these problems by using an antifungal agent that effectively inhibits fungal growth, is compatible with gypsum board materials, and can be incorporated into a cost-effective and commercially-viable manufacturing process.

BRIEF SUMMARY OF PREFERRED EMBODIMENTS

The preferred embodiments of the present invention include a novel gypsum board comprising an effective amount of an antifungal agent such that fungal growth on or in the board is inhibited. According to a preferred embodiment of the present invention, the antifungal agent is cetylpyridinium chloride (CPC), a quaternary ammonium compound. Preferably, the gypsum board comprises from about 0.01 to about 1.5 weight percent CPC based on the dry weight of the gypsum in the board. More preferably, the gypsum board comprises between about 0.5 and about 1.0 weight percent CPC based on the dry weight of the gypsum in the board. According to some preferred embodiments, the CPC is encapsulated in an encapsulator so that it is released over time and/or upon exposure to moisture.

The preferred embodiments of the present invention also include methods of preparing the novel gypsum board described above. According to some preferred embodiments, CPC is incorporated onto or into the gypsum core by premixing CPC with the water, premixing the CPC with the gypsum powder, admixing the CPC with both the water and gypsum powder prior to or in the slurry mixer, and/or adding CPC to a mixed gypsum slurry via a secondary or in-line mixer. According to other preferred embodiments, a CPC solution is sprayed onto the front and/or back paper facings. According to other preferred embodiments, CPC is incorporated into the front and/or back paper facings as they are manufactured with or without the use of retention aids and/or coupling agents in the paper making process.

DETAILED DESCRIPTION OF PREFERRED EMBODIMENTS

The present invention derives from the discovery that an effective antifungal agent exhibits compatibility with gypsum board without diminishing the qualities of the gypsum board. Preferably, the mechanical properties of the gypsum board such as density, breakstrengths, bond strength, core end and edge hardness, modulus of flexibility and the like are substantially unchanged by the addition of the antifungal agent. By substantially unchanged, a given mechanical property preferably remains within the parameters of governing standards—e.g., ASTM standards. Consequently, the novel gypsum board product achieves the structural, economic and other benefits of gypsum board while also offering significant resistance to fungal growth. The novel gypsum board product can be prepared according to methods that are cost-effective and commercially viable.

The preferred embodiments of the present invention include a novel gypsum board comprised of a gypsum core, paper surfacing bonded to both sides of the core, and an antifungal agent. Any material suitable as a gypsum core is within the scope of the present invention. Therefore, without limiting the scope of the invention, the preferred embodiments comprise a gypsum core comprised of gypsum powder, water and optionally foam, pulp, starch and/or set controlling agents. Typically, the gypsum core is sandwiched between two sheets that are commonly referred to as the front and back paper facings. The front paper facing is generally a light-colored, smoothly textured paper designed to face into the interior of the building. The back paper facing, in contrast, is typically a darker, less smoothly-textured paper designed not to be seen. Any material suitable as a front and/or back paper facing is within the scope of the present invention. Therefore, without limiting the scope of the invention, the preferred embodiments comprise front and back paper facings comprised of a cellulosic material.

The preferred embodiments of the present invention also employ an antifungal agent, as used herein meaning and including all agents, materials, and combinations thereof providing antimicrobial activity. Preferred antimicrobial agents are those of the type and in an amount effective for inhibiting the growth and/or formation of microbes such as bacteria and/or fungi. Any known antifungal agent compatible with gypsum board composition and manufacturing processes and providing the desired biocidal, antifungal, antimycogen, antibacterial, and/or like activity in the gypsum board may be employed with the present invention. As will be readily apparent to one of skill in the art, a variety of antifungal agents are known including, for example, chlorhexidine, alexidine, cetylpyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban. A preferred class of antifungal agents is quaternary ammonium compounds, including but not limited to the following compounds:

Fluoride:
- Tetra-n-butylammonium Fluoride
- Tetraethylammonium Fluoride

Chloride:
- Acetylcholine Chloride
- (3-Acrylamidopropyl)trimethylammonium Chloride
- Benzalkonium Chloride
- Benzethonium Chloride
- Benzoylcholine Chloride
- Benzylcetyldimethylammonium Chloride
- N-Benzylcinchonidinium Chloride
- N-Benzylcinchoninium Chloride
- Benzyldimethylphenylammonium Chloride
- Benzyldimethylstearylammonium Chloride
- N-Benzylquinidinium Chloride
- N-Benzylquininium Chloride
- Benzyltri-n-butylammonium Chloride
- Benzyltriethylammonium Chloride
- Benzyltrimethylammonium Chloride
- Carbamylcholine Chloride
- DL-Carnitine Hydrochloride
- Chlorocholine Chloride
- (3-Chloro-2-hydroxy-n-propyl)trimethylammonium Chloride
- Choline Chloride
- n-Decyltrimethylammonium Chloride
- Diallyldimethylammonium Chloride
- Dichloromethylenedimethyliminium Chloride
- Dimethyldistearylammonium Chloride
- n-Dodecyltrimethylammonium Chloride
- Girard's Reagent T
- n-Hexadecyltrimethylammonium Chloride
- Hexamethonium Chloride
- Lauroylcholine Chloride
- Methacholine Chloride
- Methacroylcholine Chloride
- (2-Methoxyethoxymethyl)triethylammonium Chloride
- β-Methylcholine Chloride
- Methyltriethylammonium Chloride
- Myristoylcholine Chloride
- n-Octyltrimethylammonium Chloride
- Phenyltriethylammonium Chloride
- Phenyltrimethylammonium Chloride
- Phosphocholine Chloride Calcium Salt
- Phosphocholine Chloride Sodium Salt
- Succinylcholine Chloride
- Tetra-n-amylammonium Chloride
- Tetra-n-butylammonium Chloride
- Tetradecyldimethylbenzylammonium Chloride
- n-Tetradecyltrimethylammonium Chloride
- Tetraethylammonium Chloride
- Tetramethylammonium Chloride
- Trimethyl[2,3-(dioleyloxy)propyl]ammonium Chloride
- Trimethylstearylammonium Chloride
- Trioctylmethylammonium Chloride
- Tri-n-octylmethylammonium Chloride Bromide:
- Acetylcholine Bromide
- Benzoylcholine Bromide
- Benzyltri-n-butylammonium Bromide
- Benzyltriethylammonium Bromide
- Bromocholine Bromide
- Cetyldimethylethylammonium Bromide
- Choline Bromide
- Decamethonium Bromide
- n-Decyltrimethylammonium Bromide
- Didecyldimethylammonium Bromide
- Dilauryldimethylammonium Bromide
- Dimethyldimyristylammonium Bromide
- Dimethyldioctylammonium Bromide
- Dimethyldipalmitylammonium Bromide
- Dimethyldistearylammonium Bromide
- n-Dodecyltrimethylammonium Bromide
- (Ferrocenylmethyl)dodecyldimethylammonium Bromide
- (Ferrocenylmethyl)trimethylammonium Bromide
- n-Hexadecyltrimethylammonium Bromide
- Hexamethonium Bromide
- Hexyldimethyloctylammonium Bromide
- n-Hexyltrimethylammonium Bromide
- Methacholine Bromide
- Neostigmine Bromide
- n-Octyltrimethylammonium Bromide
- Phenyltrimethylammonium Bromide
- Stearyltrimethylammonium Bromide
- Tetra-n-amylammonium Bromide
- Tetra-n-butylammonium Bromide
- Tetra-n-decylammonium Bromide
- n-Tetradecyltrimethylammonium Bromide
- Tetraethylammonium Bromide
- Tetra-n-heptylammonium Bromide
- Tetra-n-hexylammonium Bromide
- Tetramethylammonium Bromide
- Tetra-n-octylammonium Bromide
- Tetra-n-propylammonium Bromide
- 3-(Trifluoromethyl)phenyltrimethylammonium Bromide
- Trimethylvinylammonium Bromide
- Valethamate Bromide Iodide:
- Acetylcholine Iodide
- Acetyithiocholine Iodide
- Benzoylcholine Iodide
- Benzoylthiocholine Iodide
- Benzyltriethylammonium Iodide
- n-Butyrylcholine Iodide
- n-Butyrylthiocholine Iodide
- Decamethonium Iodide
- N,N-Dimethylmethyleneammonium Iodide
- Ethyltrimethylammonium Iodide
- Ethyltri-n-propylammonium Iodide
- (Ferrocenylmethyl)trimethylammonium Iodide
- (2-Hydroxyethyl)triethylammonium Iodide
- β-Methylcholine Iodide
- O-β-Naphthyloxycarbonylcholine Iodide Phenyltriethylammonium Iodide
Phenyltrimethylammonium Iodide
Tetra-n-amylammonium Iodide
Tetra-n-butylammonium Iodide
Tetraethylammonium Iodide
Tetra-n-heptylammonium Iodide
Tetra-n-hexylammonium Iodide
Tetramethylammonium Iodide
Tetra-n-octylammonium Iodide
Tetra-n-propylammonium Iodide
3-(Trifluoromethyl)phenyltrimethylammonium Iodide Hydroxide:
Benzyltriethylammonium Hydroxide
Benzyltrimethylammonium Hydroxide
Choline
n-Hexadecyltrimethylammonium Hydroxide
Phenyltrimethylammonium Hydroxide
Sphingomyelin
Tetra-n-butylammonium Hydroxide
Tetra-n-decylammonium Hydroxide
Tetraethylammonium Hydroxide
Tetra-n-hexylammonium Hydroxide
Tetramethylammonium Hydroxide
Tetra-n-octylammonium Hydroxide
Tetra-n-propylammonium Hydroxide
3-(Trifluoromethyl)phenyltrimethylammonium Hydroxide Others:
Acetylcholine Perchlorate
Benzyltrimethylammonium Dichloroiodate
Benzyltrimethylammonium Tetrachloroiodate
Benzyltrimethylammonium Tribromide
Betaine, Anhydrous
Betaine Hydrochloride
Bis(tetra-n-butylammonium) Dichromate
Bis(tetra-n-butylammonium) Tetracyanodiphenoquinodimethanide
L-Carnitine
3-[(3-Cholamidopropyl)dimethylammonio]-1-propanesulfonate
Denatonium Benzoate
n-Dodecyldimethyl(3-sulfopropyl)ammonium Hydroxide, Inner Salt
N-Fluoro-N'-(chloromethyl)triethylenediamine Bis(tetrafluoroborate)
n-Hexadecyltrimethylammonium Hexafluorophosphate
n-Hexadecyltrimethylammonium Perchlorate
n-Hexadecyltrimethylammonium Tetrafluoroborate
(Methoxycarbonylsulfamoyl)triethylammonium Hydroxide, Inner Salt
Neostigmine Methyl Sulfate
n-Octadecyldimethyl(3-sulfopropyl)ammonium Hydroxide, Inner Salt
Phenyltrimethylammonium Tribromide
Propionylcholine p-Toluenesulfonate
Tetra-n-butylammonium Azide
Tetra-n-butylammonium Bifluoride
Tetra-n-butylammonium Borohydride
Tetra-n-butylammonium Bromodiiodide
Tetra-n-butylammonium Dibromoaurate
Tetra-n-butylammonium Dibromochloride
Tetra-n-butylammonium Dibromoiodide
Tetra-n-butylammonium Dichloroaurate
Tetra-n-butylammonium Dichlorobromide
Tetra-n-butylammonium Difluorotriphenylsilicate
Tetra-n-butylammonium Difluorotriphenylstannate
Tetra-n-butylammonium Dihydrogentrifluoride
Tetra-n-butylammonium Diiodoaurate
Tetra-n-butylammonium Hexafluorophosphate
Tetra-n-butylammonium Hydrogensulfate [for Ion-Pair Chromatography]
Tetra-n-butylammonium Hydrogensulfate
Tetra-n-butylammonium Perchlorate
Tetra-n-butylammonium Perrhenate
Tetra-n-butylammonium Phosphate
Tetra-n-butylammonium Salicylate
Tetra-n-butylammonium Tetrafluoroborate
Tetra-n-butylammonium Tetraphenylborate
Tetra-n-butylammonium Thiocyanate
Tetra-n-butylammonium Tribromide
Tetra-n-butylammonium Triiodide
Tetraethylammonium Borohydride
Tetraethylammonium Perchlorate
Tetraethylammonium Tetrafluoroborate
Tetraethylammonium p-Toluenesulfonate
Tetraethylammonium Trifluoromethanesulfonate
Tetramethylammonium Acetate
Tetramethylammonium Borohydride
Tetramethylammonium Hexafluorophosphate
Tetramethylammonium Hydrogensulfate
Tetramethylammonium Perchlorate
Tetramethylammonium Sulfate
Tetramethylammonium Tetrafluoroborate
Tetramethylammonium p-Toluenesulfonate
Tetramethylammonium Triacetoxyborohydride
Tetra-n-propylammonium Perruthenate
Trifluoromethanesulfonic Acid Tetra-n-butylammonium Salt Without limiting the scope of the present invention, the preferred embodiments employ cetylpyridinium chloride (CPC) as an antifungal agent. The preferred embodiments are only exemplary: references herein to antifungal agents in general and CPC in particular are not intended to limit the scope of the invention.

Cetylpyridinium chloride—also known as CPC or n-hexadecyl pyridinium chloride—is a cationic surfactant comprised of a hydrophilic quaternary ammonium moiety and a hydrophobic alkane moiety.

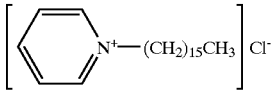

Cetylpyridinium Chloride (CPC)

CPC is commonly believed to possess biocidal activity due to its ability to bind readily to the negatively-charged cell walls of various microbes and to impact membrane integrity and function. It is a potent antifungal, antimycogen, and antibacterial chemical. CPC is commonly available in a powder form as a monohydrate manufactured by Zeeland/Cambrex and available from Johnson Matthey Catalog Company Inc. of Ward Hill, Mass., among others.

The preferred embodiments of the present invention employ an amount of CPC effective at inhibiting fungal, bacterial, and the like growth in or on the gypsum board. Preferably, the amount of CPC in and/or on the gypsum board is between about 0.01 and about 1.5 weight percent of the dry weight of the gypsum in the board. More preferably, the amount of CPC present in and/or on the gypsum board is between about 0.5 and about 1.0 weight percent of the dry weight of the gypsum in the board.

According to some preferred embodiments, the CPC is primarily present in the gypsum core. According to other preferred embodiments, the CPC is primarily located on one or both of the front and back paper facings, and more preferably on the outer surface of the front and back paper facings. According to yet other preferred embodiments, the CPC is primarily located in one or both of the front and back paper facings.

The present invention includes a novel method for the production of gypsum board comprising the addition of an antifungal agent during gypsum board manufacturing. The antifungal agent is added during manufacturing in an amount that yields an effective amount of the antifungal agent in and/or on the board such that fungal, bacterial, and the like formation and/or growth in and/or on the board is inhibited. Preferably, the finished gypsum board product comprises an amount of antifungal agent equal to from about 0.01 to about 1.5 weight percent of the dry weight of the gypsum in the board. More preferably, the finished gypsum board product comprises an amount of antifungal agent equal to from about 0.5 to about 1.0 weight percent of the dry weight of the gypsum in the board.

The gypsum board production process typically commences with the mining and transportation of gypsum rock. Once mined, the gypsum rock is crushed and ground into a fine powder. Alternatively, gypsum powder can be created synthetically. This powder is then subjected to a calcining process in which moisture is removed by heating. The novel gypsum board of the present invention may be prepared by any method capable of incorporating effective quantities of an agent having effective antifungal, antibacterial, and/or like activity into or onto the gypsum board product. Therefore, without limiting the scope of the present invention, the preferred embodiments of the present invention comprise mixing gypsum powder with water to form a gypsum slurry. Optionally, one or more of foam, pulp, starch and/or set controlling agents may be added to the slurry.

The preferred embodiments of the present invention comprise a gypsum board manufacturing process in which the slurry is deposited between two unwinding rolls of absorbent paper on a conveyor belt. Conveyor belts useful in gypsum board processing typically reach lengths of from about 200 to about 1000 feet. This belt may be operated at a speed of from about 50 to about 200 feet per minute and typically at about 110 feet per minute. This process results in a continuous sandwich of gypsum core between the two paper layers or facings. Thus, the forming gypsum board is cast as a sheet having a three-layer structure: a gypsum core having front and back paper facings. The sandwich then passes through a forming station that establishes the width and thickness of the gypsum board. As the gypsum board moves along the belt line, the slurry reverts to a solid gypsum matrix. As the gypsum core molds and hardens, it becomes firmly bonded to the outer paper layers. Once formed, the continuous board is cut to a desired length and passed through dryers to remove excess moisture.

The preferred embodiments of the present invention also comprise the addition of the antifungal agent during the gypsum board manufacturing process. The antifungal agent may be added by any method capable of incorporating effective quantities of such agent into or onto the gypsum board product. Therefore, without limiting the scope of the present invention, the preferred embodiments of the present invention comprise adding the antifungal agent into and/or onto the gypsum core and/or by depositing the antifungal agent into and/or onto the front and/or back paper facings.

The antifungal agent may be added to the gypsum slurry in any way capable of incorporating effective quantities of such agent into the gypsum core. Methods for adding CPC in solution form, powder form, or both during formation of the gypsum slurry include, but are not limited to, premixing CPC with the water, premixing the CPC with the gypsum powder, admixing the CPC with both the water and gypsum powder prior to or in the slurry mixer, or adding CPC to a mixed gypsum slurry via a secondary or in-line mixer. In a preferred embodiment, dry CPC powder is added (via screw feeder) to dry gypsum powder prior to mixing with water to form the slurry. In another preferred embodiment, a CPC solution is co-metered with water to a slurry mixer and mixed with gypsum powder therein. The CPC solution preferably comprises from about 5 to about 20 weight percent CPC based on the total weight of the solution, provided however that the concentration and/or addition rate of the CPC solution can be adjusted to match the manufacturing conditions (such as line speed, in linear feet per minute) and product specifications (such as desired concentration of CPC in the final board product, board thickness, etc.). The amount of CPC and addition rate thereof is adjusted to achieve an effective amount of CPC in the gypsum board for inhibiting fungal, bacterial, and the like formation and growth thereon, as discussed previously.

In another preferred embodiment, the CPC solution is sprayed onto the front and/or back paper facings, which may occur at one or more points in the manufacturing process. For example, the CPC solution can be sprayed onto the paper facings prior to or as they are unrolled to form the sheets, after the sheets have been formed, before and/or after drying the sheets, and/or after the sheets have been cut into boards. Furthermore, the CPC may be sprayed onto the inner surface, the outer surface, or both of the front and/or back paper facings. Preferably, the CPC solution for spraying comprises from about 5 to about 20 weight percent CPC based on the total weight of the solution.

In another embodiment, the CPC may be added to one or both of the paper facings during manufacture of the paper facings. Preferably, the paper facings further comprise one or more retention aids, coupling agents, or both, collectively referred to herein as retention aids. Retention aids are chemicals added to the pulp during paper manufacture to increase the retention of small fines, fillers, fibers, and other particles by flocculating them onto larger fibers either through chemical or mechanical means. Any suitable retention aid or combinations thereof as known to those of skill in the art that is compatible with the antifungal agent may be used in the present invention. Without limiting the scope of the invention, representative retention aids include cationic, anionic and nonionic surfactants, polyacrylamides, polyamines, polyethyleneimines, cellulosic ethers, aldohexoses, starch, and combinations thereof. Retention aid use during paper manufacture typically increases the amount of CPC (or other antifungal) incorporated therein by minimizing loss of CPC-containing fines and other particles. Furthermore, the retention aid may serve as or in combination with the controlled release agent to achieve the controlled release of antifungal agent over time as discussed herein, and a preferred retention aid for such purpose is methylcellulose. Although the use of an antifungal agent in combination with one or more retention aids has been described herein in the context of gypsum board manufacture, persons of ordinary skill will understand that the method is equally applicable to the preparation of paper products for other uses such as packaging, containers, displays, liners and tubes.

Adding CPC to the front and/or back paper facing (by either spraying or during manufacture of the paper) may be in addition to or as a substitute for adding CPC to the gypsum core of the board as described above. Thus, gypsum boards may have the following configurations: CPC treated core and untreated facings; untreated core and one or both CPC treated facings; and CPC treated core and one or both CPC treated facings.

Antifungal agents such as CPC frequently exhibit some toxicity to humans and animals. Consequently, minimizing human and animal exposure to CPC and other antifungal agents is desirable. Furthermore, the gypsum board should maintain its antifungal efficacy over an extended period of time. To accomplish these results, the preferred embodiments of the present invention include gypsum board products specifically formulated to release an active antifungal agent slowly over time or upon becoming wet such that the antifungal properties and activity of the board are maintained at an effective level over time. The preferred embodiments also include methods for making same. For example, a time-release antifungal agent may comprise an active antifungal agent combined with additional materials such as polymer binders or encapsulators to achieve the desired release profile of the active antifungal ingredient from the board over time or upon wetting.

In a preferred embodiment, the active antifungal agent is CPC and the encapsulator is J5MS Methocel hydroxypropyl methylcellulose, available from the Dow Chemical Company. Alternatively, an active ingredient such as CPC may be physically adhered within the gypsum core (for example, encapsulated by calcium within the gypsum core) or on/in the paper facings such that the CPC is released upon wetting of the gypsum core and/or paper facings. Methods for encapsulating active materials to achieve controlled release over time and/or upon wetting are well known and any such methods and processes are within the scope of the present invention.

EXAMPLE

A manufacturing trial was conducted at the gypsum board plant in Fletcher, Okla. to produce first and second sets of 0.5 inch thick sample gypsum boards comprising about 0.5 and about 1.0 weight percent CPC, respectively, based on the dry weight of the gypsum in the board. The board manufacturing line was run at a speed of 255 linear feet per minute, and separate 5 minute trials were conducted for each set of sample boards. For each five minute trial, the total water in the gypsum slurry was 1133 pounds per thousand square feet per minute of run time (lbs/MSF/min), for a total of 5665 lbs and the total dry gypsum powder was 1300 lbs/MSF/min of run time, for a total of 6500 lbs. For the 0.5% CPC board, 0.005×6500=32.5 lbs of CPC was added to the slurry as a 15 weight percent CPC solution, based on total weight of the solution. For the 1.0% CPC board, 0.01×6500=65.0 lbs of CPC was added to the slurry as a 15 weight percent CPC solution, based on total weight of the solution. A total of about 5000 square feet of each set of boards was produced.

Testing has indicated that CPC-treated gypsum board can effectively suppress bacterial and fungal growth. It is currently believed that appropriately treated gypsum board will exhibit broad-based resistance to a wide variety of microbes.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications and publications cited herein are hereby incorporated herein by reference, to the extent that they provide exemplary, procedural or other details supplementary to those set forth herein.

What is claimed is:

1. A gypsum board comprising an antifungal agent and a retention aid in one or more paper facings wherein the antifungal agent is a controlled release antifungal agent and wherein the controlled release antifungal agent comprises an active antifungal agent and one or more encapsulator or binder materials.

2. The gypsum board of claim 1 wherein the one or more encapsulator or binder materials further comprises a polymeric material.

3. The gypsum board of claim 2 wherein the polymeric material is the retention aid.

4. A gypsum board comprising an antifungal agent and a retention aid in one or more paper facings wherein the antifungal agent comprises cetylpyridinium chloride.

5. The gypsum board of claim 4 wherein the retention aid is selected from the group consisting of cationic, anionic and nonionic surfactants, polyacrylamides, polyamines, polyethyleneimines, cellulosic ethers, aldohexoses, starch, and combinations thereof.

6. The gypsum board of claim 4 wherein the gypsum board comprises a gypsum core and front and/or back paper facings and the cetylpyridinium chloride is present both in and/or on the gypsum core and in and/or on the front and/or back paper facings.

7. The gypsum board of claim 4 wherein at least a portion of the cetylpyridinium chloride is encapsulated in an encapsulator such that it is released over time, upon exposure to moisture, or both.

8. The gypsum board of claim 7 wherein the encapsulator comprises methylcellulose.

9. A gypsum board comprising an antifungal agent and a retention aid in one or more paper facings wherein the antifungal agent is a controlled release antifungal agent, wherein the retention aid is selected from the group consisting of cationic, anionic and nonionic surfactants, polyacrylamides, polyamines, polyethyleneimines, cellulosic ethers, aldohexoses, starch and combinations thereof.

10. A method for manufacturing a gypsum board comprising facing a gypsum core with paper facings and adding an antifungal agent and a retention aid to one or more of the paper facings, wherein the gypsum board comprises a gypsum core and additional antifungal agent is added to the gypsum core.

11. The method of claim 10 wherein the antifungal agent and retention aid are added to the one or more paper facings during manufacture of the paper facings.

12. A method for manufacturing a gypsum board comprising facing a gypsum core with paper facings and adding an antifungal agent and a retention aid to one or more of the paper facings, wherein the antifungal agent comprises cetylpyridinium chloride.

13. The method of claim 12 wherein the retention aid is selected from the group consisting cationic, anionic and nonionic surfactants, polyacrylamides, polyamines, polyethyleneimines, cellulosic ethers, aldohexoses, starch, and combinations thereof.

14. A method for manufacturing a gypsum board comprising facing a gypsum core with paper facings and adding an antifungal agent and a retention aid to one or more of the paper facings, wherein the retention aid is selected from the group consisting of cationic, anionic and nonionic surfactants, polyamines, polyethyleneimines, cellulosic ethers, aldohexoses, starch, and combinations thereof.

15. A method for manufacturing a gypsum board comprising facing a gypsum core with paper facings and adding an antifungal agent and a retention aid to one or more of the paper facings, wherein the antifungal agent is a controlled release antifungal agent and further comprising encapsulating or binding the antifungal agent such that the antifungal agent is released over time, upon exposure to moisture, or both.

16. The method of claim 15 wherein the antifungal agent is encapsulated or bound using one or more polymeric materials.

17. The method of claim 16 wherein the polymeric material is the retention aid.

18. The method of claim 17 wherein the retention aid is methylcellulose.

19. An antifungal paper comprising an antifungal agent and a retention aid, wherein the antifungal agent comprises cetylpyridinium chloride; and wherein the retention aid is selected from the group consisting of cationic, anionic and nonionic surfactants, polyacrylamides, polyamines, polyethyleneimines, cellulosic ethers, aldohexoses, starch, and combinations thereof.

20. A gypsum board comprising an antifungal agent and a retention aid in one or more paper facings wherein the antifungal agent comprises a compound selected from the group consisting of chlorhexidine, alexidine, cetyl pyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban.

21. The gypsum board of claim 20 wherein the retention aid is selected from the group consisting of cationic, anionic and nonionic surfactants, polyacrylamides, polyamines, polyethyleneimines, cellulosic ethers, aldohexoses, starch, and combinations thereof.

22. A method for manufacturing a gypsum board comprising facing a gypsum core with paper facings and adding an antifungal agent and a retention aid to one or more of the paper facings, wherein the antifungal agent comprises a compound selected from the group consisting of chlorhexidine, alexidine, cetyl pyridinium chloride, benzalkonium chloride, benzethonium chloride, stearalkonium chloride, hexetidine, triclosan and triclocarban.

23. The method of claim 22 wherein the retention aid is selected from the group consisting cationic, anionic and nonionic surfactants, polyacrylamides, polyamines, polyethyleneimines, cellulosic ethers, aldohexoses, starch, and combinations thereof.

24. An antifungal paper comprising an antifungal agent and a retention aid, wherein the antifungal agent comprises a compound selected from the group consisting of chlorhexidine, alexidine, cetyl pyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban; and wherein the retention aid is selected from the group consisting of cationic, anionic and nonionic surfactants, polyacrylamides, polyamines, polyethyleneimines, cellulosic ethers, aldohexoses, starch, and combinations thereof.

* * * * *